United States Patent [19]

Jakubaschk et al.

[11] Patent Number: 4,587,756

[45] Date of Patent: May 13, 1986

[54] MAGAZINE FOR A SMALL ARM

[75] Inventors: Horst Jakubaschk, Oberndorf-Bochingen; Erich Weisser, Tennenbronn, both of Fed. Rep. of Germany

[73] Assignee: Heckler & Koch GmbH, Fed. Rep. of Germany

[21] Appl. No.: 629,990

[22] Filed: Jul. 12, 1984

[30] Foreign Application Priority Data

Jul. 13, 1983 [DE] Fed. Rep. of Germany ..... 3325216

[51] Int. Cl.[4] ..... F41C 25/02; F41C 27/14

[52] U.S. Cl. ..... 42/50; 42/1 B

[58] Field of Search ..... 42/50, 1 B

[56] References Cited

U.S. PATENT DOCUMENTS 1,252,094 1/1918 DeLempdes ..... 42/1 B 2,828,568 4/1958 Sakewitz ..... 42/50

FOREIGN PATENT DOCUMENTS 77878 8/1949 Czechoslovakia ..... 42/50

92987 7/1896 Fed. Rep. of Germany .

1278287 9/1968 Fed. Rep. of Germany .

8201106 10/1982 Fed. Rep. of Germany .

*Primary Examiner*—Charles T. Jordan

[57] ABSTRACT

A magazine (1) for a small arm comprising a follower spring (3) and a follower (6), and means for indicating the loading condition of the magazine is characterized in that indicator means (4, 5) responding to the position of a section (3') of the follower spring (3) located at a distance from the follower (6) are provided at a point of the magazine (1) which is visible when the firearm is ready to fire. This permits the loading condition to be determined in a very simple manner.

11 Claims, 4 Drawing Figures

MAGAZINE FOR A SMALL ARM

The present invention relates to a magazine for a small arm comprising a follower spring and a follower, and means for indicating the loading condition of the magazine.

There have been known pistol magazines in which one or more slots or other openings provided in the wall and extending over the full length of the magazine permit the user to determine the loading condition before inserting the magazine into the firearm. After the magazine has been inserted, the slots are, however, no longer visible.

Now, it is the object of the present invention to improve a magazine of the type described above so that the loading condition of the magazine can be determined at any time also when the firearm is ready to fire.

According to the invention, this object is achieved in that indicator means responding to the position of a section of the follower spring located at a distance from the follower is provided at a point of the magazine which is visible when the firearm is ready to fire.

The advantage of this invention resides in the fact that the shooter can determine the loading condition of the magazine by a glance at the indicator means which is visible also when the firearm is ready to fire. Due to the fact that the indicator means utilizes the movement of a section of the follower spring located at a distance from the follower, the movement performed by the said portion of the follower spring when the follower moves over the path corresponding to the difference between the full and the empty magazine must be smaller than the movement performed by the follower which gives the possibility to realize the indicator means in a very simple manner.

According to one embodiment of the invention, for example, the indicator means is arranged near the bottom of the magazine, i.e. in the area of the end of the follower spring opposite the follower. One winding of the follower spring located near the bottom of the magazine performs a movement much smaller than that of the follower. Ideally, this dependence is a linear one which means that a winding of the follower spring located at about one tenth of the length of the follower spring, from the bottom of the magazine, will perform a movement corresponding to only ten percent of the movement performed by the follower.

The described arrangement of the indicator means near the bottom of the magazine permits, for example, the movement of that part of the magazine between the full and empty conditions of the magazine which is utilized for indication purposes to be as small as approx. 1 to 2 cm.

In one embodiment of the invention comprising a recess in a side wall of the magazine through which the loading condition of the magazine can be determined visually and the loading spring can be seen, as for instance in the above-mentioned pistol magazines, the recess is provided at a point of the magazine which is visible when the firearm is ready to fire, and one winding of the follower spring located within the viewing area of the recess, at least in certain selected loading conditions of the magazine, is provided with a mark that can be observed visually.

The advantage of this arrangement is to be seen in the fact that the mark which distinguishes the winding carrying the mark from other windings of the follower spring permits the shooter to recognize the loading condition of the magazine at a glance.

In one embodiment of the invention, the recess is provided near the bottom of the magazine. This offers the advantage that the length of the recess in the longitudinal direction of the magazine can be kept small because a long movement of the follower results in only a small movement of the marked winding.

The interdependence between the visibility of the mark and the loading condition of the magazine may be selected at desire. For example, the arrangement may be such that the mark will become visible only when the ammunition in the magazine has been reduced to a predetermined number; or else the arrangement may be such that the mark disappears from the viewing area when the ammunition in the magazine drops below the said pre-determined number. In a preferred embodiment of the invention, the length and size of the recess are, however, such that the winding carrying the mark remains visible over the full range of loading conditions of the magazine. In this case, the location of the marked winding within the recess, which varies due to the different compression of the follower spring resulting from the loading condition of the magazine, is used as a measure for the loading condition of the magazine.

In one embodiment of the invention, the mark is a color mark which means that one winding, or merely half a winding, of the follower spring has a color contrasting with that of the other windings. This marking is simple and clearly visible. In the simplest of all cases it can be provided by painting. If necessary, a phosphorescent paint may be used for marking so that the indicator means is effective also at night, and without outside light.

In one embodiment of the invention, the recess is covered by a transparent cover which is tight to dust and humidity. Such a cover serves to prevent operating trouble. It also helps protect the color mark from becoming soiled and invisible.

In one embodiment of the invention, a graduation coacting with the mark is provided in the area of the recess. The graduation permits the loading condition of the magazine to be assessed immediately, without reflection. The graduation may be provided along the edge of the recess; however, when a transparent cover is used, the latter may be used preferably as a carrier for the graduation. Again, a phosphorescent paint may be used for this graduation.

In one embodiment of the invention, a shaft seated in an opening in one wall of the magazine carries on its outer end a pointer, while its other end portion is connected in driving relationship with a winding of the follower spring so that the shaft is pivoted when the said winding performs a movement in the longitudinal direction of the magazine. This permits a mechanical indicator means to be realized advantageously in an extremely simple manner. When the arrangement is such that the position of the pointer can be made out by touching, and not only visually, then the shooter will be able to assess the loading condition of the magazine even in the dark.

In one embodiment of the invention, the shaft carries on its inner end a disk provided with a radial slot which is engaged by a pin connected in driving relationship with the said winding. In the case of such an arrangement, the movement performed by the pin in the longitudinal direction will be smaller normally than the diameter of the disk so that it cannot come off the slot and that, further, the torque causing the shaft to rotate will be produced every time the direction of movement of the pin is reversed. The advantage of this embodiment of the invention is to be seen in its extreme simplicity.

The pin can be mounted movably in the magazine in a particularly simple manner by arranging it on a guide piece inserted between two windings of the follower spring. The guide piece may, preferably, fill substantially the whole cross-section of the magazine which will protect it very well against tilting and/or twisting and jamming. In the described embodiment of the invention, the guide piece is held safely between the two windings delimiting it at the front and back, viewed in the longitudinal direction of the magazine; it is not necessary to fix it to the spring by means of particular connection elements.

The opening through which the shaft extends is preferably sealed off.

In the case of firearms which have the magazine attached to their outside, as is the case for instance with the known G 3 rifle, the design of the magazine according to the invention does not require any modifications to the firearm itself. No modifications to the firearm itself are also required in cases where, although the magazine is inserted into the firearm, its end portion supporting the follower spring projects from the firearm far enough to permit the indicator means to be provided in this projecting end portion. But for cases where the indicator means of the magazine is covered up by other parts of the firearm, one embodiment of the invention provides that the firearm is provided with a viewing opening in the area of the indicator means of the magazine. If necessary, this viewing opening may also be closed by a transparent cover. In the latter case, the transparent cover of the magazine may perhaps be found to be superfluous.

Other features and advantages of the invention will be apparent from the claims and the following description of examples of the invention when read with reference to the drawing which shows certain details essential to the invention, it being understood that the different features may be realized in any embodiment of the invention either alone or in any desired combination. In the drawings:

Figure 1:
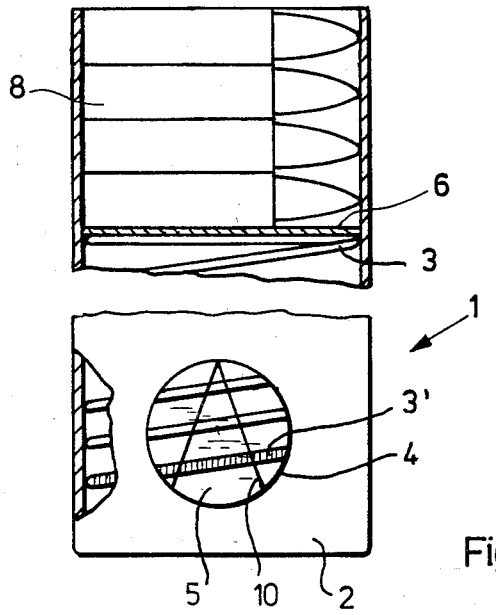
FIG. 1 shows a side view, partly broken away, of a loaded magazine of a first embodiment of the invention.
Figure 2:
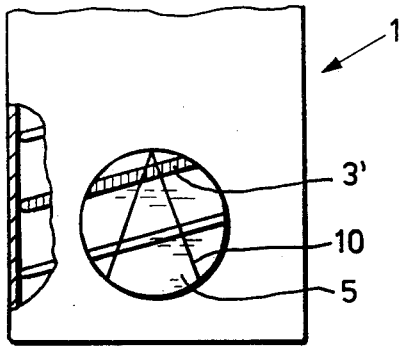
FIG. 2 shows the bottom portion of the magazine in the empty condition.

In FIGS. 1 and 2 it can be seen that the magazine 1 comprises a circular recess 4 in the side wall facing the viewer near the bottom 2 supporting the follower spring 3, the recess 4 being covered up by a snap-fitted dust-tight and humidity-tight cover 5 in the manner of a watch-glass. The free end of the follower spring 3 carries in a conventional manner the follower 6 above which cartridges 8 will be present when the magazine is loaded at least partly.

The follower spring 3 is designed conventionally in the form of a helical spring of rectangular cross-section. One half of a winding which is located in the area of the recess 4, whether the magazine is full (FIG. 1) or empty (FIG. 2), is marked in a color (red) differing from that of the other parts of the follower spring 3. In the drawing, this is indicated by the hatched portion marked 3'. The cover 5 is provided additionally with a symbolic graduation 10 in the form of a "V" pointing upwards and indicating in a clearly understandable manner that when the marked winding approaches the pointed end of the graduation 10, the supply of ammunition in the magazine is running out.

Figure 3:
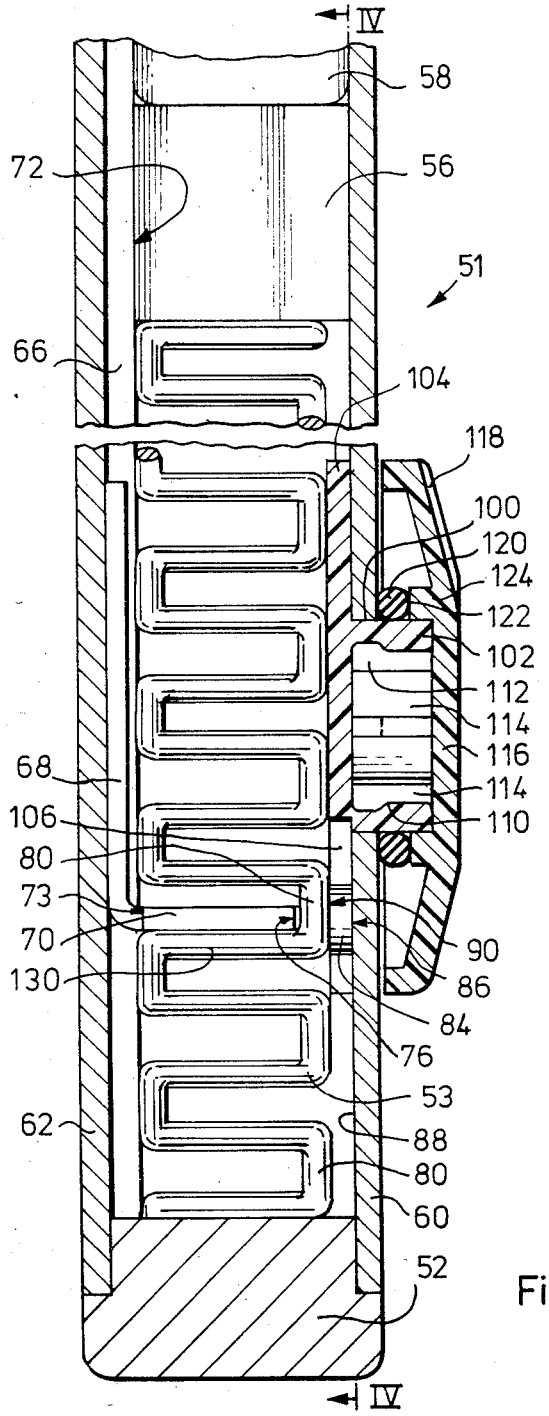
FIG. 3 shows a longitudinal section through a magazine according to a second embodiment of the invention, taken mainly along line A—A in FIG. 4, but including also a section through certain parts of the indicator means.
Figure 4:
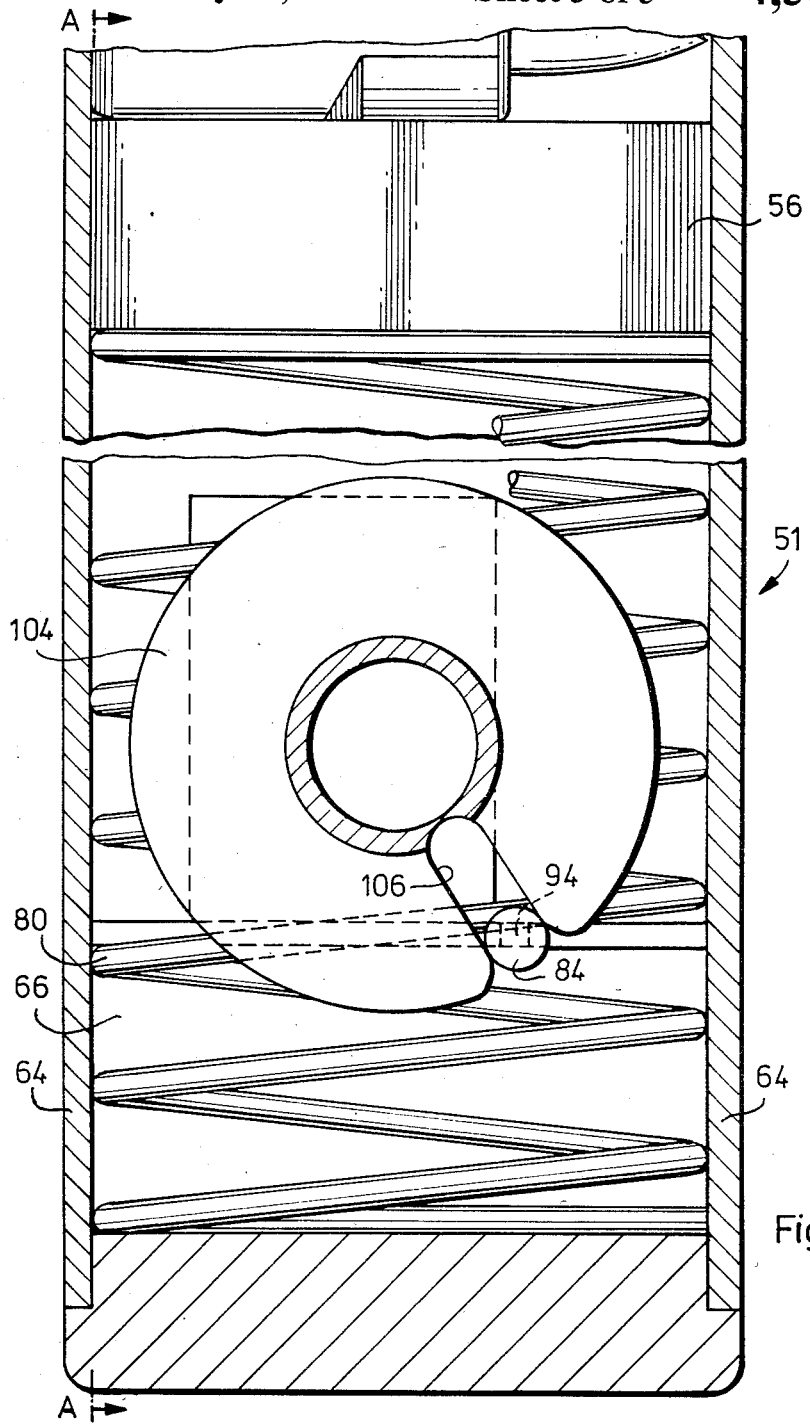
FIG. 4 shows a sectional view taken along line IV—IV in FIG. 3, with the indicator means in its correct angular position.

In the embodiment shown in FIGS. 3 and 4, the magazine 51 comprises a follower spring 53 and a follower 56. A cartridge 58 which is in contact with the face of the follower 56 opposite the follower spring 53 is shown partly broken away.

The follower spring 53 is provided within the inner space of the magazine 51 which is defined by a bottom 52, side walls 60 and 62 and front and rear walls 64 extending at a right angle thereto, and the follower 56. The side wall 62 is provided with a shallow groove 66 extending in the longitudinal direction of the magazine and enclosing a guide portion 68 of a guide piece. The guide portion 68 extends parallel to the plane of the side wall 62, at a distance from the front and rear walls 64. The guide piece comprises further a crosspiece 70 extending over the full width of the magazine corresponding to the width of the cartridge 58, i.e. the interior distance between the front and rear walls 64, the plane of the crosspiece 70 extending substantially at a right angle to the plane of the front and rear walls 64 and the side walls 60 and 62 and, thus, at a right angle to the plane of the guide portion 68. There exists only a very small distance between the end face of the crosspiece 70 adjacent the side wall 62 and the inner face 72 of the side wall 62. As mentioned before, the guide portion 68 projects into the recess 66 and is, therefore, closer to the outside of the side wall 62 than the end face 73 of the crosspiece 70. The distance between the end face 76 of the crosspiece 70 neighboring the side wall 60 and extending rectangularly relative to the drawing plane of FIG. 3, and the inner face of the side wall 60 is such to permit a section 80 of the follower spring 53 to pass between this end face 76 and the side wall 60. In addition to the guide portion 68 and the crosspiece 70, the guide piece further comprises a guide pin 84 which has its end face 86 adjacent the side wall 60 in loose contact with the inner face 88 of the side wall 60. Its other end face 90 which extends parallel to the end face 86 is spaced from the end face 76 by a distance a little greater than the wire thickness of the follower spring 53 so that, viewed from the right in FIG. 3, the section 80 of the follower spring is located behind the guide pin 84. The guide pin 84 is formed integrally with the crosspiece 70 and connected with the latter via a shaft 94 of a length a little greater than the wire thickness of the follower spring 53. The guide portion 68 prevents the crosspiece 70 of the guide piece from changing its position in which it extends substantially parallel to the bottom 52, thus ensuring proper performance of the indicator means.

The side wall 60 is provided with a circular opening 100 through which a tubular shaft 102 is passed from the inside. The tubular shaft 102 is formed integrally with a disk 104 which rests flat against the inner face 88 of the side wall 60. The disk 104 comprises a radially extending slot 106 which is engaged by the guide pin 84. For clarity's sake, the slot 106 is shown in FIG. 3 at an angular position in which its longitudinal axis extends parallel to the direction of movement of the follower 56. In reality, however, the slot 106 never occupies such a position. The shaft 102 comprises an inwardly projecting circumferential projection 110 coacting with projections 112 provided on resilient tongues 114 which are formed integrally with an indicator element 116 and snap-fitted in the shaft 102. The indicator element 116 has substantially the form of a circular cap carrying a radially extending groove 118 serving as pointer. The coacting projections 110 and 112 form a snap-on connection between the indicator element 116 and the disk 104. Before mounting the indicator element 116, an O-ring seal 120 was fitted on the outside of the shaft 102. An end face 122 of a flange-like projection 124 formed integrally with the indicator element 116 and extending in radial direction immediately adjacent the outside of the shaft 102 is urged against this O-ring seal 120 to form a liquid-tight seal which prevents water from penetrating from the outside into the magazine, through the gap between the shaft 102 and the edge of the opening 100.

Now, when the follower 58 changes its position, the section 80 of the follower spring 53 is displaced simultaneously, together with the immediately adjacent section 130 of the follower spring 53 extending in the drawing plane of FIG. 3. When cartridges 58 are withdrawn from the magazine, the last-mentioned section 130 of the follower spring 53 pushes against the crosspiece 70 of the guide piece and causes it to move together with it. Loading cartridges into the magazine causes the follower to move towards the bottom 52 so that the guide piece moves past the section 80 of the follower spring 53 which rests against the stem 94. Accordingly, both the guide piece and the pin 84 follow every movement of the follower 56; but the length of the displacement performed by the pin 84 is considerably smaller than that of the follower 56 because the winding of the follower spring 53 engaging the guide piece is very close to the bottom 52. In the example shown of the drawing, it is the third winding of the follower spring of a total of 60 windings counted from the bottom 53.

As the pin 84 moves along its path, it rotates the disk 104 and also the indicator element 116 which is with the disk in driving relationship. The manner in which this connection is effected is not visible in the drawing. It is realized by a projection extending radially outwardly from one of the tongues 114 and engaging a corresponding recess in the shaft 102.

The angular displacement performed by the disk 104 in the example shown in the drawing between the full and the empty conditions of the magazine is equal to approx. 120°. The outside of the side wall 60 carries a graduation coacting with the groove 118 serving as a pointer so that the shooter can determine at a glance if the magazine is full or almost full, empty or almost empty or loaded to some degree between these two extreme conditions.

It is not possible in the described embodiments to determine exactly whether the magazine is completely full or completely empty. But this is not what the invention is proposed to do.

The reference numbers given in the claims are not to be understood as limitation, but meant only to facilitate the reader's understanding.

We claim:

1. A magazine for a small arm comprising a follower spring and a follower, means for indicating the loading condition of the magazine, and indicator means responding to the position of a section of the follower spring located at a distance from the follower and provided at a point of the magazine which is visible when the small arm is adapted to be fired, said indicator means comprising a recess in a side wall of the magazine, one winding of the follower spring which is located in the viewing area of the recess, at least in certain selected loading conditions of the magazine, being provided with a visual mark, said recess being sealed off by a transparent humidity-type cover.

2. A magazine in accordance with claim 1, wherein the position and size of the recess are such that the winding carrying the mark is visible in all loading conditions of the magazine.

3. A magazine in accordance with claim 1, wherein a graduation coacting with the mark is provided in the area of the recess.

4. A magazine in accordance with claim 1, characterized in that the indicator means are arranged near the bottom of the magazine.

5. A magazine for a small arm comprising a follower spring and a follower, means for indicating the loading condition of the magazine, and indicator means responding to the position of a section of the follower spring located at a distance from the follower and provided at a point of the magazine which is visible when the small arm is adapted to be fired, said indicator means comprising a recess in a side wall of the magazine, one winding of the follower spring which is located in the viewing area of the recess, at least in certain selected loading conditions of the magazine, being provided with a visual color mark, said recess being sealed off by a transparent humidity-type cover.

6. A magazine for a small arm comprising a follower spring and a follower, means for indicating the loading condition of the magazine, indicator means responding to the position of a section of the follower spring located at a distance from the follower and provided at a point of the magazine which is visible when the small arm is adapted to be fired, and a shaft seated in an opening of a wall of the magazine and carrying at an outer end thereof a pointer, its other end being connected in driving relationship with a winding of the follower spring to pivot the shaft when said winding moves in a longitudinal direction of the magazine.

7. A magazine in accordance with claim 6, wherein the shaft carries on its inner end a disk provided with a radial slot which is engaged by a pin connected in driving relationship with the said winding.

8. A magazine in accordance with claim 7, wherein the pin is arranged on a guide piece inserted between two windings of the follower spring.

9. A magazine in accordance with claim 8, wherein the guide piece fills substantially the whole cross-section of the magazine.

10. A magazine in accordance with claim 6, wherein the opening is sealed off substantially water-tight.

11. A magazine in accordance with claim 6, wherein the indicator means are arranged near the bottom of the magazine.

* * * * *